US005884674A

United States Patent [19]

Steiner

[11] Patent Number: 5,884,674

[45] Date of Patent: Mar. 23, 1999

[54] SHED HOLDER ARRANGEMENT FOR A WEAVING ROTOR IN A SERIES SHED LOOM

[75] Inventor: Alois Steiner, Rieden, Switzerland

[73] Assignee: Sulzer Rueti AG, Rueti, Switzerland

[21] Appl. No.: 898,542

[22] Filed: Jul. 22, 1997

[30] Foreign Application Priority Data

Sep. 24, 1996 [EP] European Pat. Off. ..... 96810627

[51] Int. Cl.[6] ..... D03C 13/00; D03D 41/00

[52] U.S. Cl. ..... 139/28

[58] Field of Search ..... 139/28

[56] References Cited

U.S. PATENT DOCUMENTS

| | | | |
|---|---|---|---|
| 4,291,729 | 9/1981 | Steiner | 139/28 |
| 4,498,501 | 2/1985 | Steiner | 139/28 |
| 5,431,194 | 7/1995 | Steiner et al. | 139/28 |

*Primary Examiner*—Andy Falik
*Attorney, Agent, or Firm*—Townsend and Townsend and Crew LLP

[57] ABSTRACT

A weaving rotor for a series shed weaving machine has shed holder elements arranged on the surface of the weaving rotor, with at least some of the shed holder elements arranged following one another in the circumferential direction of the weaving rotor being displaced in the axial direction with respect to the weaving rotor.

5 Claims, 2 Drawing Sheets

SHED HOLDER ARRANGEMENT FOR A WEAVING ROTOR IN A SERIES SHED LOOM

BACKGROUND OF THE INVENTION

The invention relates to a weaving rotor for a series shed weaving machine.

Known series shed weaving machines comprise a rotatable rotor which has shed holder elements arranged so as to be aligned in the direction of rotation. A disadvantage of this arrangement is to be seen in the fact that a complicated and expensive laying-in device is required in order to lay in warp threads correctly into the shed holder elements in such a manner that the warp threads laid into the weaving rotor form an open shed for the insertion of a weft thread.

SUMMARY OF THE INVENTION

The object of the present invention is to provide an economically more advantageous weaving rotor.

The object is satisfied in particular in that at least some of the sequential shed holder elements in the peripheral direction of the weaving rotor are displaced in the axial direction relative to the weaving rotor.

In an advantageous embodiment of the invention, all shed holder elements arranged adjacently in the peripheral direction are each arranged for displacement by the same distance in the axial direction with respect to the weaving rotor.

A weaving rotor equipped in this manner has the advantage that no movable laying-in device is required. Only a firmly mounted guide device for the warp threads is required, for example in the form of firmly mounted eyes or reed-like guide devices. Through the rotation of the weaving rotor, the shed holder elements dip into the warp threads, which are kept aligned by the guide device, with the relative position in the axial direction between a warp thread and the shed holder element in each case determining whether the warp thread comes to lie in an upper or lower position of the shed holder element. Thus the arrangement of the shed holder elements on the weaving rotor determines the weave of the developing cloth, without requiring a movable laying-in device for the warp threads. The simplest weave type obtainable is a so-called 1/1 weave, in that all mutually adjacent shed holder elements in the peripheral direction are arranged for displacement by the same distance in the axial direction, and in that in each case the next but one shed holder elements in the peripheral direction are alternately arranged at the same position in the axial direction.

Since the arrangement of the shed holder elements at the surface of the weaving rotor determines the weave of the cloth, a wealth of different weave types can be obtained by arranging the shed holder elements on the weaving rotor accordingly. Thus a weaving rotor can be arranged for example for a 1/1 weave or a 1/2 weave or a 1/3 weave through a corresponding arrangement of the shed holder elements.

It can prove advantageous to operate the initially described weaving rotor with at least one of the shed holder elements displaced in the axial direction in combination with a movable, actively driven laying-in device for the warp threads. This combination has the advantage that the cloth weave is substantially determined by the arrangement of the shed holder elements on the weaving rotor so that the task of the laying-in device largely becomes that of reliably laying the warp threads into the shed-forming upper and lower points of the shed holder elements, which is of especial importance in particular for a high warp thread density. An advantage of this arrangement can be seen in the fact that not all the warp threads need be guided via actively driven laying-in devices, for which reason a reduced number of actively controllable laying-in devices is required, which saves costs accordingly.

DESCRIPTION OF THE PREFERRED EMBODIMENTS

Figures 1A, 1B:
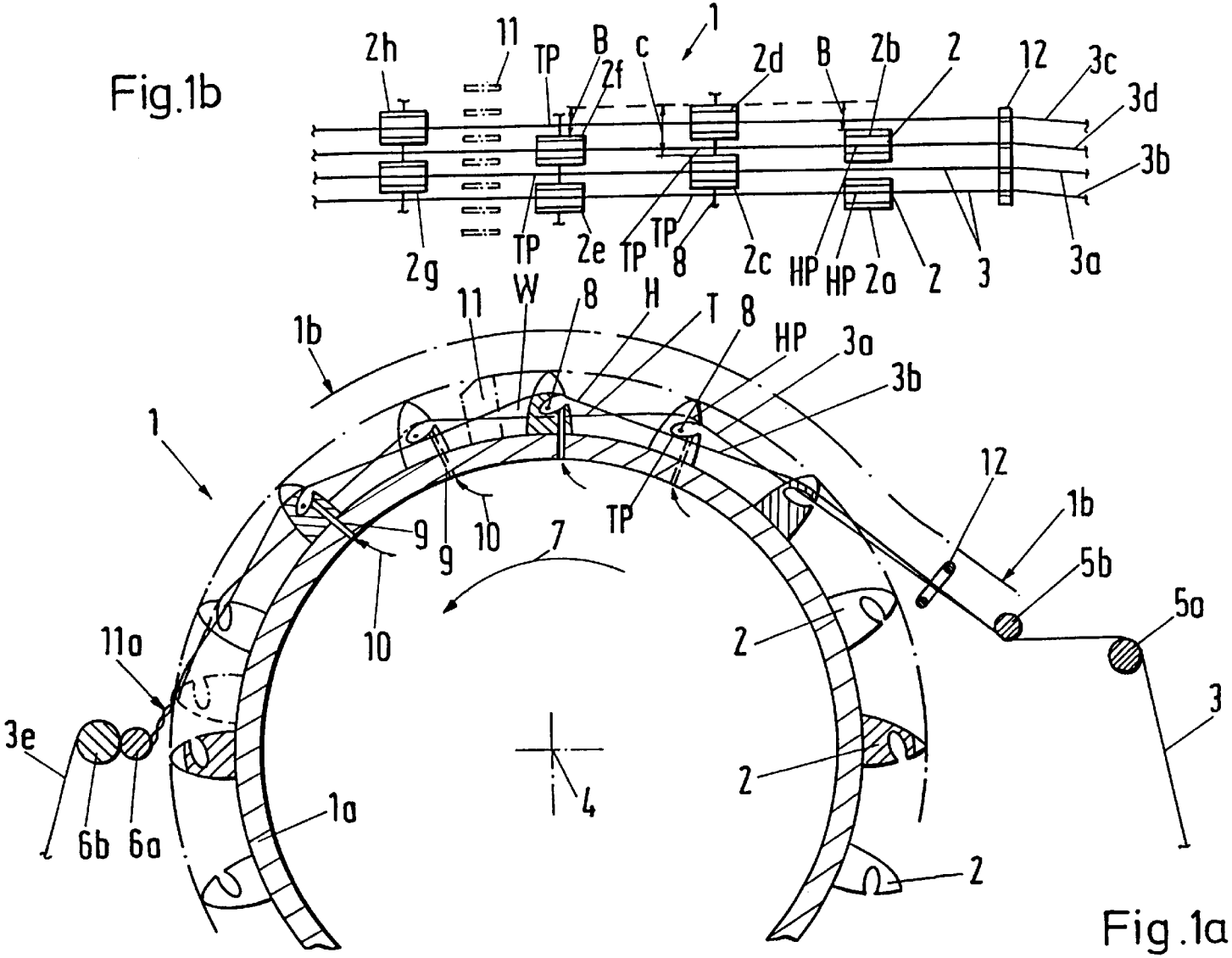
FIG. 1*a* is a side view of a section through a weaving rotor of a series shed weaving machine.
FIG. 1*b* is a plan view of the weaving rotor of FIG. 1 along the line A—A.

The sectional representation through a weaving rotor 1 of a series shed weaving machine shows the jacket 1*a* of the weaving rotor 1 with shed holder elements 2, 2*a*, 2*b*, 2*c*, 2*d*, 2*e*, 2*f*, 2*g*, 2*h* arranged on the surface which serve to hold a warp thread 3, 3*a*, 3*b* in an upper shed position H or a lower shed position T. A shed W is thereby formed between the warp threads 3*a*, 3*b* into which a weft thread 8 can be inserted with the help of a fluid 10 acting on the weft thread 8. In the exemplary embodiment shown, several of the shed holder elements 2 have a fluid supply channel 9 through which the fluid 10 is supplied and blown into the weft insertion channel formed by the shed holder element 2. The shed holder elements 2 are, as illustrated in FIG. 1*b*, arranged so as to be aligned in the direction axial to the weaving rotor 1 so that a weft insertion channel extending over the entire width of the warp threads 3 is formed. The warp threads 3, 3*a*, 3*b*, 3*c*, 3*d* are conveyed to the weaving rotor 1 over deflection rollers 5*a*, 5*b* and the finished cloth 3*e* led off from the weaving rotor 1 over deflection rollers 6*a*, 6*b*. Additional beat-up lamella 11 can be arranged at the surface of the weaving rotor 1 in order to beat up the weft thread 8 securely against a cloth edge 11*a*. The weaving rotor 1 has a center of rotation 4 and a direction of rotation 7.

The plan view of the weaving rotor 1 in FIG. 1*b* along the A—A shows the path of the warp threads 3*a*, 3*b*, 3*c*, 3*d* with respect to the shed holder elements 2*a*, 2*b*, 2*c*, 2*d*, 2*e*, 2*f*, 2*g*, 2*h*. All shed holder elements 2 are spaced at a distance C in the axial direction with respect to the weaving rotor 1. Shed holder elements 2 arranged following one another or adjacently in the circumferential direction of the weaving rotor 1 are in each case arranged so as to be displaced by a distance B in the axial direction with respect to the weaving rotor 1. The distance B amounts to one half the distance C so that the next but one alternating shed holder elements 2 in the circumferential direction, that is, the shed holder elements 2*b* and 2*f*, or the shed holder elements 2*a* and 2*e*, are arranged identically with respect to the direction of rotation 7, or, to put it differently, have no displacement in the axial direction and are thus arranged in circumferential alignment. The warp threads 3*a*, 3*b*, 3*c*, 3*d* are guided by a guiding element 12 which is firmly mounted and provided with eyes for the warp threads.

Through the weaving rotor 1 rotating in the direction of rotation 7 the shed holder elements 2 are combed into the warp threads 3, 3*a*, 3*b*, 3*c*, 3*d*, which are held by the guiding element 12, so that the shed holder elements 2 come into contact with the warp threads 3, 3*a*, 3*b*, 3*c*, 3*d*. Here the shed holder elements 2, 2*a*, 2*b*, 2*c*, 2*d*, 2*e*, 2*f*, 2*g*, 2*h* are arranged displaced in the axial direction on the weaving rotor 1 in such a manner that the shed holder elements 2*a*, 2*b* lift the warp threads 3*b*, 3*d* in the radial direction so that the warp threads 3*b*, 3*d* take up a high point position HP at these shed holder elements 2*a*, 2*b*. The positions of the warp threads 3*a*, 3*c*, are, on the contrary, not influenced by the shed holder elements 2*a*, 2*b*, which leads to a low point position TP of the warp threads 3*b*, 3*d*, as illustrated between the shed holder elements 2*c*, 2*d*. The shed holder elements 2*c*, 2*d* are arranged to be displaced by the distance B in the axial direction of the weaving rotor 1 so that these shed holder elements 2*c*, 2*d* lift the warp threads 3*a*, 3*c*, and bring them to a high point position HP. Through this influencing of the radial position of the warp threads 3*a*, 3*b*, 3*c*, 3*d*, a shed W through which a weft thread 8 can be inserted is formed at each of the shed holder elements 2*a*, 2*b*, 2*c*, 2*d*, 2*e*, 2*f*, 2*g*, 2*h*. The mutual positions of the warp threads 3, 3*a*, 3*b*, 3*c*, 3*d* on insertion of the weft thread 8 determine the resultant weave of the cloth 3*e*. In the present embodiment a so-called 1/1 weave is produced, in that each of the warp threads 3*a*, 3*b*, 3*c*, 3*d* comes to lie alternately in its direction of travel above or below the weft thread 8. The arrangement of the shed holder elements 2*a*, 2*b*, 2*c*, 2*d*, 2*e*, 2*f*, 2*g*, 2*h* illustrated in FIG. 1*b* is only one of a wealth of possibilities which result when shed holder elements 2 that are arranged following one another in the peripheral direction of the weaving rotor are arranged so as to be displaced in the axial direction of the weaving rotor 1. As can be seen from FIG. 1*b*, the arrangement of the shed holder elements 2, 2*a*, 2*b*, 2*c*, 2*d*, 2*e*, 2*f*, 2*g*, 2*h* determines the weave of the cloth 3*e* so that cloth with a great variety of different weave types can be produced by a corresponding arrangement of the shed holder elements 2 on the weaving rotor 1. Thus, for example, 1/2 weaves or 1/3 weaves are also simple to produce. The shed holder elements 2 are securely mounted on the weaving rotor 1 so that only a single weave type can be woven with the weaving rotor 1 when the guiding element 12 remains fixed. It is advantageous to maintain a stock of weaving rotors 1 with differing equipment of the shed holder elements 2, i.e. differing weave type, so that when the weave type is changed, the weaving rotor 1 of the series shed weaving machine need only be replaced by a weaving rotor 1 of a different type of weave in order to rapidly produce the desired new type of weave. Instead of replacing the entire weaving rotor 1, it is also possible to jointly displace or exchange the individual shed holder elements 2 which are arranged next to one another in rows in the axial direction with respect to the weaving rotor 1, with only a portion of the rows requiring displacement or replacement depending on the chosen weave type.

In the exemplary embodiment shown, the guiding element 12, which is also designated as a laying-in rail, is securely mounted with respect to the position of the rotor 1. It can thus prove advantageous to use a plurality of guiding elements 12, 12*a*, 12*b* in such a manner that, for example, the one guiding element 12*a* guides the warp threads 3*a*, 3*c* and the other guiding element 12*b* guides the warp threads 3*b*, 3*d*. It can further prove advantageous for the guiding elements 12*a*, 12*b* to be controllably movable with respect to the weaving rotor 1, at least in an axial direction. If the warp threads 3 are laid into the shed holder elements 2 by the controllably movable guiding elements 12, then the warp threads can be laid into the high points HP of the shed holder elements 2 with greater reliability, in particular at a high warp thread density. Here the weave of the cloth 3*e* is substantially determined by the arrangement of the shed holder elements 2, with the controllably movable guiding elements 12*a*, 12*b* ensuring that the warp threads 3 are reliably laid into the high points HP of the shed holder elements 2, or into the intermediate spaces between the shed holder elements 2 even at high warp thread densities.

Figure 1C:
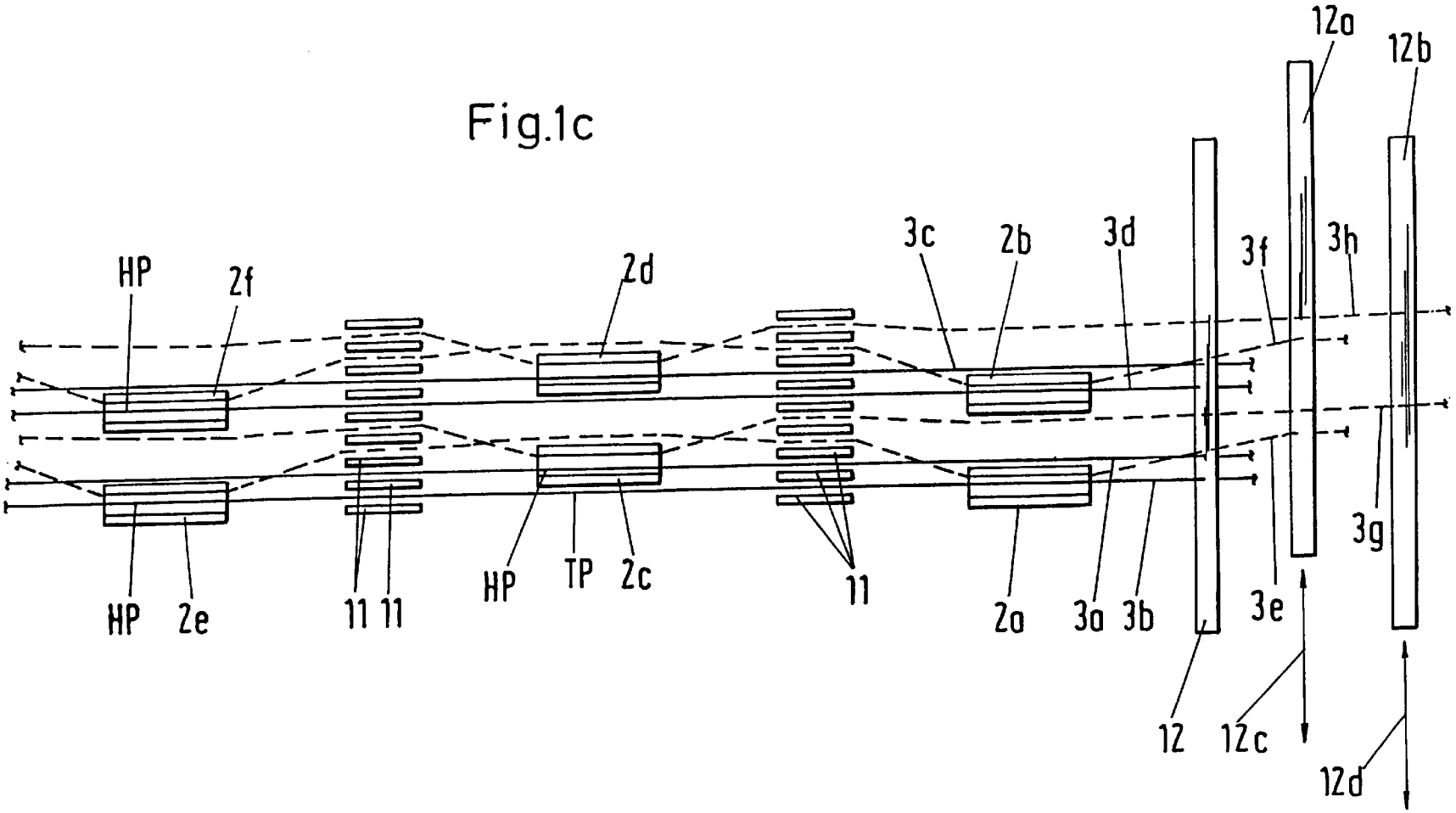
FIG. 1*c* is a plan view of the weaving rotor with additional, movable guide elements.

There can be seen from the plan view of a further weaving rotor 1 in FIG. 1*c* the path of the warp threads 3*a*, 3*b*, 3*c*, 3*d*, 3*e*, 3*f*, 3*g*, 3*h* which are laid into the weaving rotor 1 with respect to the shed holder elements 2*a*, 2*b*, 2*c*, 2*d*, 2*e*, 2*f* and the beat-up lamella 11. The shed holder elements 2*a*, 2*b*, 2*c*, 2*d*, 2*e*, 2*f*, which are arranged following one another in the peripheral direction of the weaving rotor 1, are, as also shown in FIG. 1*b*, arranged spaced apart in the axial direction with respect to the weaving rotor 1. In comparison with the arrangement of the warp threads in the embodiment of FIG. 1*b*, the embodiment of FIG. 1*c* has a greater number of warp threads 3*a*, 3*b*, 3*c*, 3*d*, 3*e*, 3*f*, 3*g*, 3*h* laid into the weaving rotor 1. The guiding element 12 is mounted securely and immovably in the series shed weaving machine and has eyes for guiding the warp threads 3*a*, 3*b*, 3*c*, 3*d*, with the eyes being arranged with respect to the weaving rotor 1 in such a manner that the warp threads 3*a*, 3*b*, 3*c*, 3*d* are laid into high points HP or low points TP of the shed holder elements 2, 2*a*, 2*b*, 2*c*, 2*d*, 2*e*, 2*f*. For a large number of warp threads and/or for a high warp thread density, there is the danger that the warp threads do not come to lie in the intended high points HP or low points TP, which would result in a weaving error after insertion of the weft thread. In order to reliably lay the warp threads 3*e*, 3*f*, 3*g*, 3*h* likewise into the high points HP and low points TP of the shed holder elements 2, 2*a*, 2*b*, 2*c*, 2*d*, 2*e*, 2*f*, the warp threads 3*e*, 3*f* are guided by a guiding element 12*a* which is movable back and forth in the direction 12*c*, parallel to the direction of extent of the axis 4. The guiding element 12*a* has non-illustrated eyes, which guide the warp threads 3*e*, 3*f*. Likewise, the warp threads 3*g*, 3*h* are guided by a guiding element 12*b* which is movable back and forth in the direction 12*d*. These movable guiding elements 12*a*, 12*b*, together with a non-illustrated drive and actuation device, form a so-called laying-in device, which permits the warp threads 3*e*, 3*f*, 3*g*, 3*h* to be laid into the shed holder elements 2, 2*a*, 2*b*, 2*c*, 2*d*, 2*e*, 2*f* in a manner controlled in dependence on the angle of rotation of the weaving rotor 1 so that the warp threads 3*e*, 3*f*, 3*g*, 3*h* are reliably laid into the corresponding high points HP and low points TP. An advantage of the arrangement shown in FIG. 1*c* is to be seen in the fact that the relatively expensive, movable guiding elements 12*a*, 12*b* are required only for a high warp thread density, whereas the fixed guiding element 12 suffices in order to reliably lay in the warp threads 3 at a lower warp thread density.

I claim:

1. A series shed weaving machine comprising:

a weaving rotor;

a plurality of shed holder elements arranged on a surface of the weaving rotor, at least some of the shed holder elements which are arranged in series in a circumferential direction of the weaving rotor being displaced in an axial direction with respect to the weaving rotor;

at least one stationary guide element of a fixed position for guiding and laying-in warp threads into the weaving rotor; and at least one movable guide element journalled movably in the axial direction with respect to the weaving rotor for movably guiding and laying-in some of the warp threads into the weaving rotor.

2. A series shed weaving machine in accordance with claim 1 wherein the plurality of shed holder elements which are arranged in series in the circumferential direction of the weaving rotor are alternately displaced in the axial direction with respect to the weaving rotor.

3. A series shed weaving machine in accordance with claim 2 wherein the alternately displaced shed holder elements are displaced by the same distance in the axial direction with respect to the weaving rotor.

4. A series shed weaving machine in accordance with claim 2 wherein the alternately displaced shed holder elements include alternating shed holder elements which are at the same axial position along the weaving rotor.

5. A series shed weaving machine in accordance with claim 1 wherein the plurality of shed holder elements are arranged to extend in the circumferential direction of the weaving rotor.

* * * * *